US010458315B2

(12) United States Patent
Isogai et al.

(10) Patent No.: US 10,458,315 B2
(45) Date of Patent: Oct. 29, 2019

(54) COMPRESSOR STRUCTURE FOR TURBOCHARGERS

(71) Applicant: OTICS Corporation, Nishio (JP)

(72) Inventors: Tomoyuki Isogai, Aichi (JP); Tetsuya Niwa, Aichi (JP)

(73) Assignee: OTICS Corporation, Nishio (JP)

( * ) Notice: Subject to any disclaimer, the term of this patent is extended or adjusted under 35 U.S.C. 154(b) by 774 days.

(21) Appl. No.: 14/877,233

(22) Filed: Oct. 7, 2015

(65) Prior Publication Data

US 2016/0123346 A1 May 5, 2016

(30) Foreign Application Priority Data

Oct. 29, 2014 (JP) ..... 2014-219818

(51) Int. Cl.
*F04D 29/42* (2006.01)
*F02B 33/40* (2006.01)
*F04D 29/62* (2006.01)

(52) U.S. Cl.
CPC ..... *F02B 33/40* (2013.01); *F04D 29/422* (2013.01); *F04D 29/4253* (2013.01); *F04D 29/624* (2013.01)

(58) Field of Classification Search
CPC combination set(s) only.
See application file for complete search history.

(56) References Cited

U.S. PATENT DOCUMENTS 4,676,717 A * 6/1987 Willyard, Jr. ..... F01D 9/026 29/402.08
4,919,592 A 4/1990 Sears et al.
(Continued)

FOREIGN PATENT DOCUMENTS

CN 102933855 A 2/2013
CN 103671264 A 3/2014
(Continued)

OTHER PUBLICATIONS

Extended European Search Report dated Feb. 24, 2016 in Patent Application 15188949.0.
(Continued)

*Primary Examiner* — Carlos A Rivera
*Assistant Examiner* — Wayne A Lambert
(74) *Attorney, Agent, or Firm* — Oblon, McClelland, Maier & Neustadt, L.L.P.

(57) ABSTRACT

A compressor structure for turbochargers 1 including a scroll piece 20, a shroud piece 30 and a seal plate 40 assembled with each other in an axial direction, wherein the scroll piece 20 includes a penetration part 22 penetrating in the axial direction so as to constitute a discharge port 13 and a first intermediate wall surface 23 smoothly extending from an intake-side wall surface 21 to the discharge port 13, the shroud piece 30 includes an inner circumferential side wall surface 32, and the seal plate 40 includes a protruding part 42 provided with a second intermediate wall surface 43 extending from an outer circumferential side wall surface 41 and facing the first intermediate wall surface 23 so as to constitute an inner wall surface 14*a* of an intermediate part 14 through which the discharge port 13 and the scroll chamber 12 are communicated with each other.

1 Claim, 4 Drawing Sheets

(56) References Cited

U.S. PATENT DOCUMENTS

| | | | | |
|---|---|---|---|---|
| 6,193,463 | B1 * | 2/2001 | Adeff | F04D 29/023 415/196 |
| 7,001,148 | B2 * | 2/2006 | Cardenas | F04D 25/04 415/196 |
| 7,862,298 | B2 * | 1/2011 | Cvjeticanin | F04D 29/023 415/215.1 |
| 8,419,359 | B2 * | 4/2013 | Cvjeticanin | B29C 45/14467 415/200 |
| 2006/0127242 | A1 * | 6/2006 | Martin | F04D 25/04 417/407 |
| 2010/0232955 | A1 * | 9/2010 | Schick | B29C 65/08 415/204 |
| 2013/0039750 | A1 | 2/2013 | Osuka et al. | |
| 2014/0086726 | A1 | 3/2014 | Isogai | |
| 2014/0112762 | A1 | 4/2014 | Isogai | |
| 2014/0314553 | A1 * | 10/2014 | Dehnen | F04D 25/024 415/182.1 |
| 2016/0053760 | A1 | 2/2016 | Theelen et al. | |
| 2017/0114714 | A1 * | 4/2017 | Niwa | F02B 37/025 |
| 2018/0283394 | A1 * | 10/2018 | Miyoshi | F02C 7/00 |
| 2018/0313361 | A1 * | 11/2018 | Niwa | F04D 29/441 |

FOREIGN PATENT DOCUMENTS

| | | | |
|---|---|---|---|
| CN | 103775210 | A | 5/2014 |
| CN | 104024650 | A | 9/2014 |
| EP | 2 107 249 | A2 | 10/2009 |
| EP | 2 107 249 | A3 | 10/2009 |
| JP | 8-284881 | A | 10/1996 |
| JP | 4778097 | | 9/2011 |
| JP | 2011-231620 | A | 11/2011 |
| WO | WO 2014/161050 | A1 | 10/2014 |

OTHER PUBLICATIONS

Japanese Office Action dated Oct. 3, 2017 in Patent Application No. 2014-219818 (with English Translation).

Combined Office Action and Search Report dated Jun. 29, 2017 in Chinese Patent Application No. 201510718105.5 (with English translation, Downloaded from the Global Dossier on the EPO website).

* cited by examiner

COMPRESSOR STRUCTURE FOR TURBOCHARGERS

CROSS-REFERENCE

This application claims priority to Japanese patent application no. 2014-219818 filed on Oct. 29, 2014, the contents of which are entirely incorporated herein by reference.

BACKGROUND OF THE INVENTION

Field of the Invention

The present invention relates to a compressor structure for turbochargers.

Description of the Related Art

A turbocharger installed in an engine compartment of an automobile or the like is configured so that air drawn in by a compressor is compressed and discharged toward an internal-combustion engine. That is, an air flow path formed inside a compressor housing includes a scroll chamber into which compressed air discharged from an impeller flows. The scroll chamber is configured to guide the compressed air to a discharge port and discharge the compressed air from the discharge port to the internal-combustion engine side.

PATENT DOCUMENT

Patent Document 1: Japanese Patent No. 4778097

SUMMARY OF THE INVENTION

In recent years, the engine compartment of an automobile or the like has been made increasingly smaller and narrower. Accordingly, a turbocharger, when mounted inside the engine compartment, has to be installed in a limited space. Consequently, a discharge port of a compressor housing tends to be increasingly complex in shape. It is therefore conceivable that the compressor housing is molded by means of gravity casting or low-pressure casting, in order to deal with such a complex shape. Since casting can be performed using a so-called core, these methods provide high degree of freedom of the shapes and can deal with complicated shapes. These methods have a long casting cycle, however, and are therefore inferior in productivity and high in cost. The methods also have another problem in which the degree of surface roughness increases if a sand mold or the like is used, thus degrading the efficiency of a compressor.

On the other hand, a method for molding the compressor housing by means of die casting is available. This method has a short casting cycle, compared with gravity casting and low-pressure casting, and is therefore superior in productivity and low in cost. However, this method cannot be applied to the compressor housing which does not have a shape releasable from a die (shape having no undercuts). The method is thus low in the degree of shape-designing freedom and cannot deal with complicated shapes. Hence, as disclosed in Japanese Patent No. 4778097, there is provided a compressor housing configured by assembling three pieces, i.e., a scroll piece, a shroud piece and an outer circumferential annular piece, with each other. With this compressor housing, the degree of shape-designing freedom is secured for the scroll chamber of the compressor housing, while each piece can be made to have a shape to be easily molded by die casting.

However, a discharge port, though not disclosed in the compressor housing described in Japanese Patent No. 4778097, is conventionally arranged so as to extend in a circumferential direction from a scroll chamber, or arranged through an intermediate part bent in a direction inclined from the scroll chamber toward the axial direction of a rotor shaft. Accordingly, in order to mold the scroll piece including the discharge port by die casting, a core needs to be used. Alternatively, a die-casting die for molding the scroll chamber and a die-casting die for forming the discharge port need to be prepared separately, and the two die-casting dies need to be pulled out in different directions for separation, which results in increase of manufacturing cost for the compressor housing. On the other hand, it is conceivable that each of the pieces constituting the compressor housing are divided further to be easily separated from the die. In such a case, there arises other problem in which the number of components increases and an assembling process becomes cumbersome and complicated, thus causing manufacturing cost increase.

The present invention, which has been accomplished in view of such a background, is intended to provide a compressor structure for turbochargers by which the manufacturing cost is reduced.

SUMMARY OF THE INVENTION

One aspect of the present invention provides a compressor structure for turbochargers configured to be able to accommodate an impeller and including an intake port for drawing in air toward the impeller; a scroll chamber formed in a circumferential direction on an outer circumferential side of the impeller in such a manner to flow air discharged from the impeller; a discharge port for discharging air flowing through the scroll chamber to an outside; and an intermediate part for communicating the discharge port and the scroll chamber, the compressor structure including a scroll piece, a shroud piece and a seal plate assembled with each other in an axial direction as separate members, wherein the scroll piece includes the intake port formed penetrating in the axial direction; an intake-side wall surface constituting a wall surface of the scroll chamber on an intake side on an outer circumferential side of the intake port; a penetration part formed penetrating in the axial direction and having an intake side end constituting the discharge port; and a first intermediate wall surface configured to constitute a part of the inner wall surface of the intermediate part, smoothly extending from the intake-side wall surface to the discharge port in such a manner that an extending direction of the first intermediate wall surface approaches a direction parallel to the axial direction by being bent toward the intake side, the shroud piece includes a cylindrical shroud press fitting part to be press-fitted into the intake port; an inner circumferential side wall surface constituting a wall surface on an inner circumference side of the scroll chamber; a shroud surface opposed to the impeller; and a diffuser surface extending from the shroud surface toward the scroll chamber, the seal plate includes an outer circumferential side wall surface constituting a wall surface on an outer circumferential side of the scroll chamber; and a protruding part protruding toward the intake side so as to be inserted into the penetration part in the axial direction, and the protruding part includes a second intermediate wall surface configured to constitute a part of the inner wall surface of the intermediate part, the second intermediate wall surface extending from the outer circumferential side wall surface in such a manner that an extending direction of the second intermediate wall surface approaches a direction parallel to the axial direction by being bent toward the intake side and facing the first intermediate wall surface.

In the above-described compressor structure for turbochargers, the scroll piece, the shroud piece and the seal plate are assembled with each other in the axial direction. The penetration part penetrating through the scroll piece in the axial direction is formed in the scroll piece, and the intake-side end of the penetration part constitutes the discharge port. The first intermediate wall surface formed extendedly from an intake-side wall surface forming the scroll chamber in such a manner to bend in the axial direction, smoothly connects to the discharge port. In addition, the protruding part protrudingly formed in the axial direction corresponding to the direction of assembly at the seal plate is inserted in the penetration part. The second intermediate wall surface opposed to the first intermediate wall surface is formed in the protruding part. The first intermediate wall surface and the second intermediate wall surface form the inner wall surface of the intermediate part through which the discharge port and the scroll chamber are communicated with each other.

With this configuration, the scroll piece forming the discharge port and the seal plate can have a shape releasable from a die (shape having no undercuts) in an insertion direction, i.e., the axial direction. It is therefore possible to mold the scroll piece by die casting, instead of gravity casting or low-pressure casting, and reduce the cost of manufacture. The cost of manufacture can also be reduced since a die-casting die for molding the scroll chamber and a die-casting die for molding the discharge port need not be prepared separately.

As described above, according to the present invention, it is possible to provide a compressor structure for turbochargers which enable manufacturing cost reduction.

DETAILED DESCRIPTION OF THE PREFERRED EMBODIMENTS

In the above-described compressor structure for turbochargers, the term "circumferential direction" refers to the rotational direction of the impeller, whereas the term "axial direction" refers to the direction of the rotational axis of the impeller. In addition, the term "intake side" refers to the open side of the intake port, i.e., the compressor structure side in the axial direction of a rotor shaft serving as the rotational axis of the impeller accommodated in the compressor structure. This means that a center housing for bearing the rotor shaft is positioned on "the opposite side of the intake side."

Each of the first intermediate wall surface and the second intermediate wall surface is formed to have a semicircular-arc shapes in a cross-section of the intermediate part vertical to a flow path. In addition, the first and second intermediate wall surfaces can be formed so as to face with each other so as to allow the inner wall surface of the intermediate part to have a circular shape in the abovementioned cross-section. Consequently, the intermediate part is formed so that a cross-section of the intermediate part in the axial direction is substantially circular and the intermediate part extends in such a manner that an extending direction of the intermediate part approaches a direction parallel to the axial direction.

EMBODIMENTS

Embodiment 1

An embodiment of the above-described compressor structure for turbochargers will be described referring to FIGS. 1 to 5.

Figure 1:
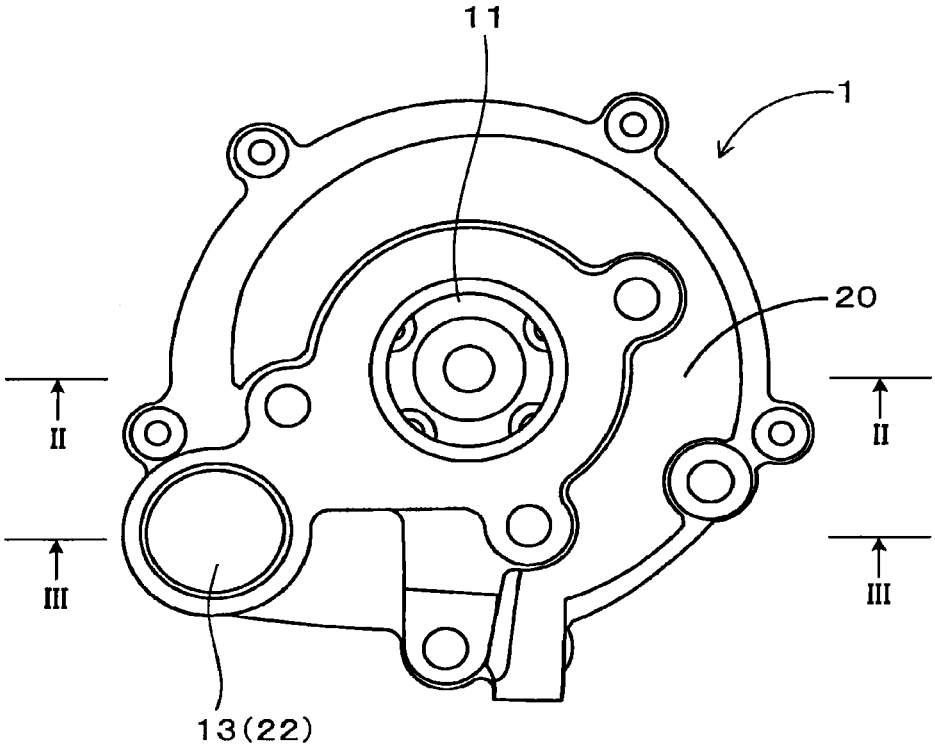
FIG. 1 illustrates the upper surface of a compressor structure in Embodiment 1.
Figure 2:
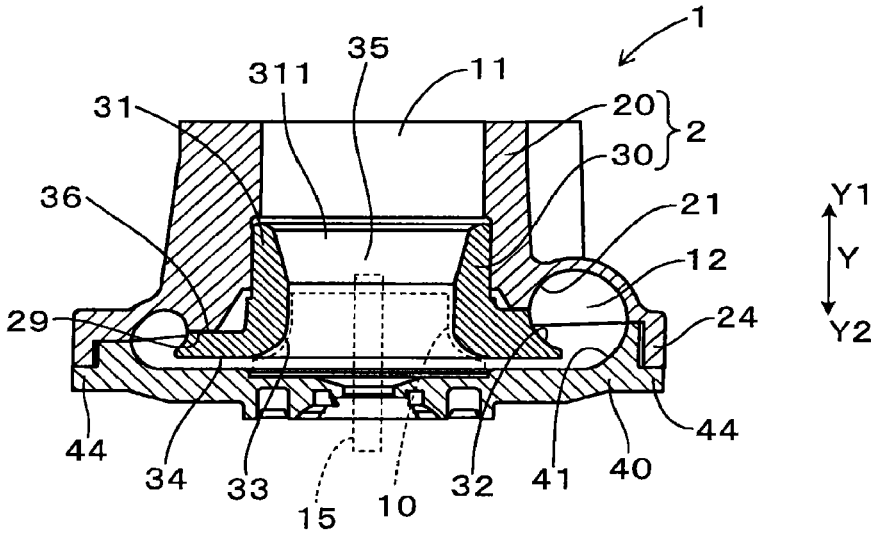
FIG. 2 is a cross-sectional view taken along the II-II line of in FIG. 1.
Figure 3:
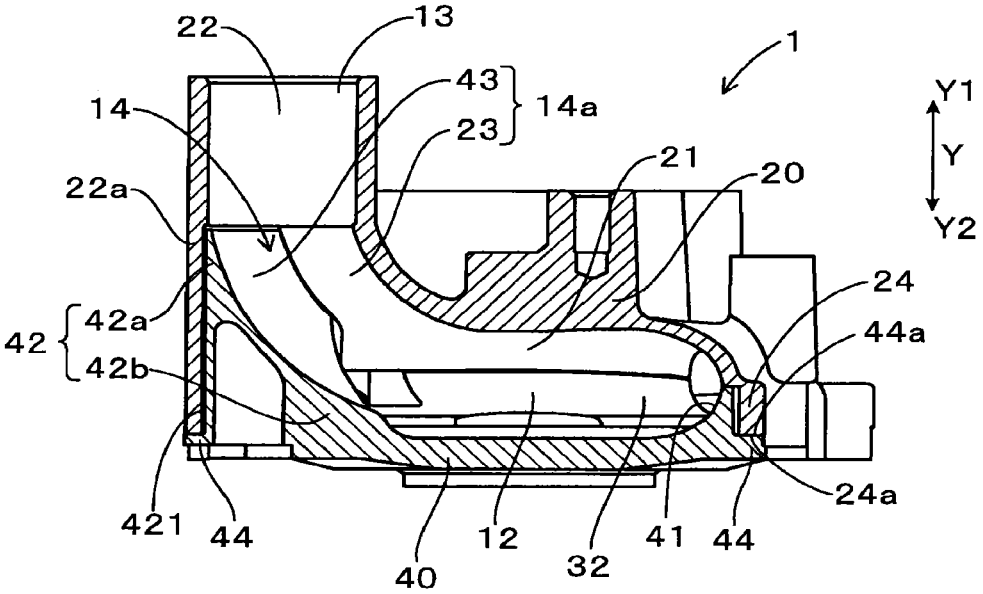
FIG. 3 is a cross-sectional view taken along the line of in FIG. 1.

As illustrated in FIGS. 1 and 2, the compressor structure 1 for turbochargers is configured to be able to accommodate an impeller 10, and includes an intake port 11, a scroll chamber 12 and a discharge port 13. In addition, the compressor structure 1 includes an intermediate part 14, as illustrated in FIG. 3.

The intake port 11 draws in air toward the impeller 10.

The scroll chamber 12 is formed in a circumferential direction on the outer circumferential side of the impeller 10, and flows air discharged from the impeller 10.

The discharge port 13 discharges air flowing through the scroll chamber 12 to the outside.

The intermediate part 14 allows the discharge port 13 and the scroll chamber 12 to be communicated with each other, as illustrated in FIG. 3.

Figure 4:
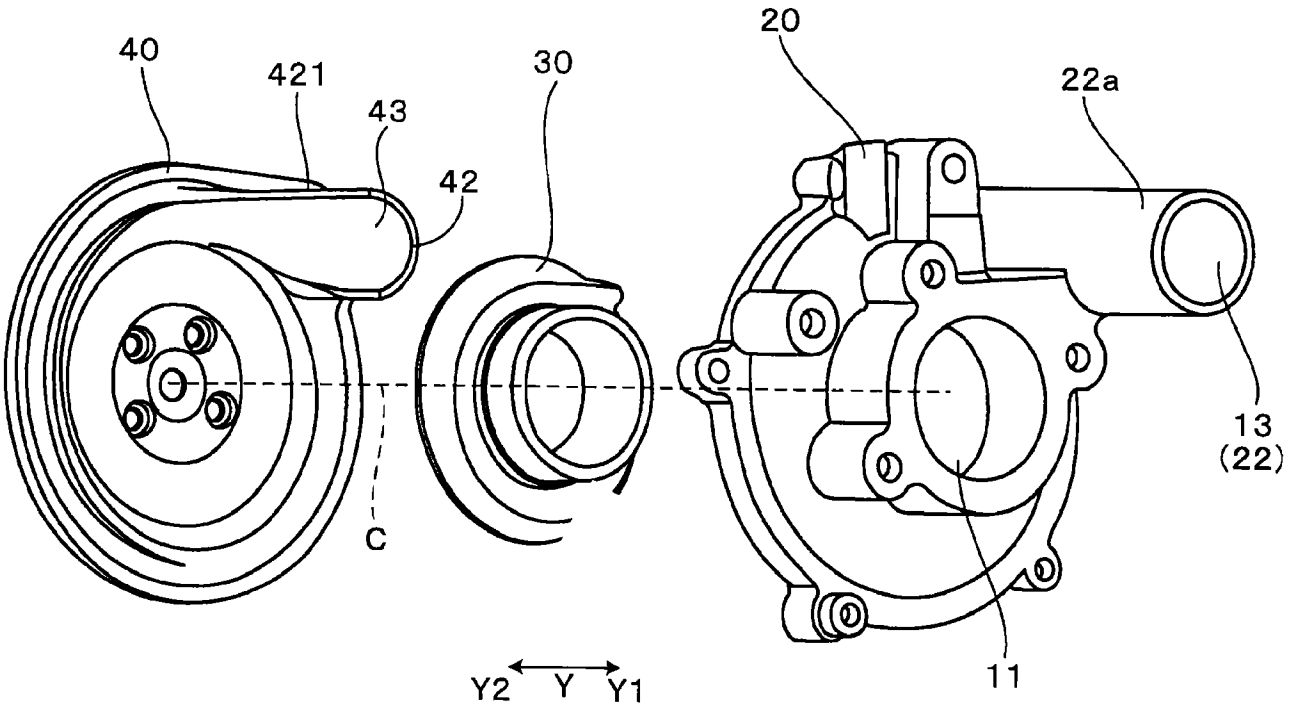
FIG. 4 is an exploded perspective view of the compressor structure in Embodiment 1.
Figure 5:
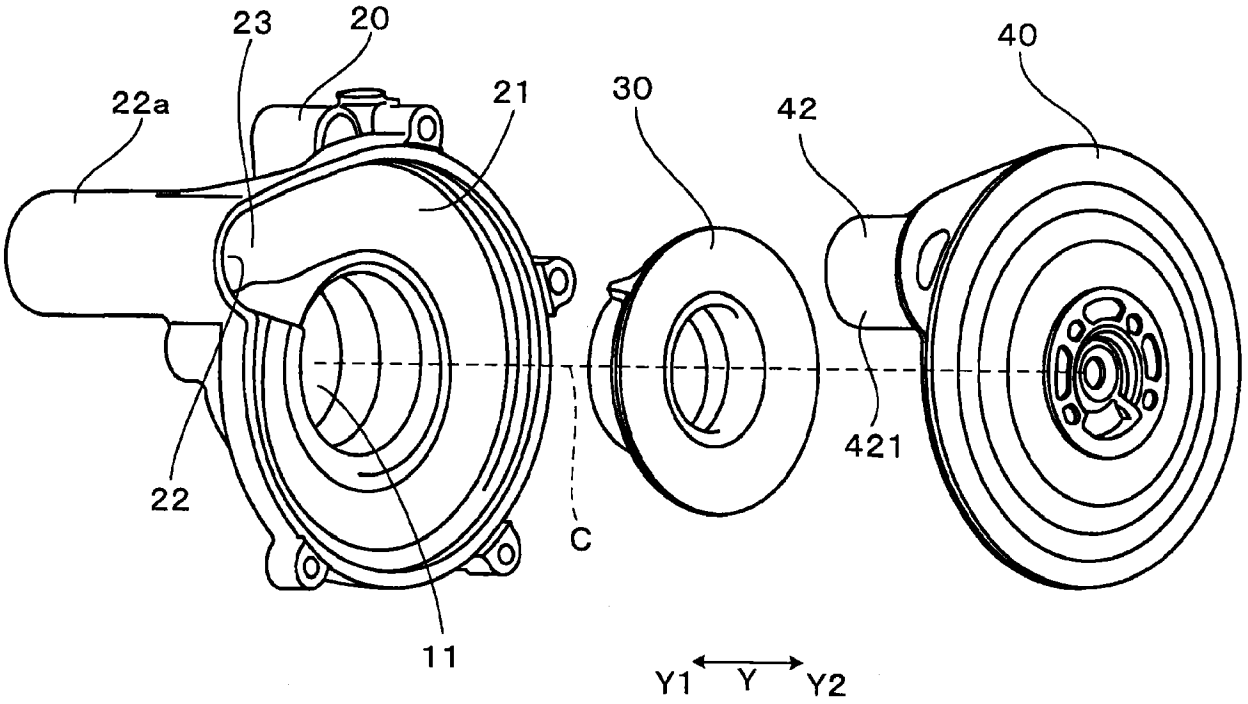
FIG. 5 is another exploded perspective view of the compressor structure in Embodiment 1.

As illustrated in FIGS. 4 and 5, the compressor structure 1 is configured by assembling a scroll piece 20, a shroud piece 30 and a seal plate 40 formed as separate members in the axial direction.

The scroll piece 20 includes an intake port 11, an intake-side wall surface 21, a penetration part 22 and a first intermediate wall surface 23, as illustrated in FIGS. 1 to 3.

The intake port 11 is formed penetrating in an axial direction Y.

The intake-side wall surface 21 constitutes a wall surface of the scroll chamber 12 on the intake side Y1.

The penetration part 22 is formed penetrating in the axial direction Y, and an end of the penetration part on the intake side Y1 constitutes a discharge port 13.

The first intermediate wall surface 23 is smoothly extended from the intake-side wall surface 21 to the discharge port 13 in such a manner that an extending direction approaches a direction parallel to the axial direction Y by being bent. In other words, the first intermediate wall surface 23 is extended from the intake-side wall surface 21 so as to bend toward the intake side Y1 on a plane parallel to the axial direction Y, thus smoothly connecting to the discharge port 13, as illustrated in FIG. 3. In addition, the first intermediate wall surface 23 constitutes part of the inner wall surface 14*a* of the intermediate part 14.

The shroud piece 30 includes a shroud press fitting part 31, an inner circumferential side wall surface 32, a shroud surface 33 and a diffuser surface 34, as illustrated in FIG. 2.

The shroud press fitting part 31 is formed into a cylindrical shape and press-fitted into the intake port 11.

The inner circumferential side wall surface 32 constitutes a wall surface of the scroll chamber 12 on the inner circumferential side.

The shroud surface 33 is opposed to the impeller 10.

The diffuser surface 34 extends from the shroud surface 33 toward the scroll chamber 12.

The seal plate 40 includes an outer circumferential side wall surface 41 and a protruding part 42, as illustrated in FIG. 3.

The outer circumferential side wall surface 41 constitutes a wall surface of the scroll chamber 12 on the outer circumferential side.

The protruding part 42 is formed protruding on the intake side Y1, so as to be inserted into the penetration part 22 in the axial direction Y. A second intermediate wall surface 43 facing the first intermediate wall surface 23 and constituting part of the inner wall surface 14*a* of the intermediate part 14 is formed on the protruding part 42. The second intermediate wall surface 43 is extended from the outer circumferential side wall surface 41 in such a manner an extending direction of the second intermediate wall surface 43 approaches a direction parallel to the axial direction Y by being bent toward the intake side Y1. In other words, the second intermediate wall surface 43 is extended from the outer circumferential side wall surface 41 so as to bend toward the intake side Y1 on a plane parallel to the axial direction Y, as illustrated in FIG. 3.

A mode for assembling the compressor structure 1 is as follows:

First, the shroud piece 30 is assembled with the scroll piece 20 to form the compressor housing 2 (see FIG. 2). After axle-related components (not illustrated) are assembled with a center housing (not unillustrated), the seal plate 40 is assembled with the center housing. Thereafter, a turbine impeller (not illustrated) fitted with the impeller 10 and a rotor shaft 15 is assembled with the center housing. The compressor housing 2 is assembled with the seal plate 40 fitted on the center housing while adjusting the phase of the discharge port 13. The compressor structure 1 is thus brought to completion.

That is, the scroll piece 20, the shroud piece 30 and the seal plate 40 are assembled along the axial direction Y, as illustrated in FIGS. 4 and 5. As illustrated in FIG. 3, the scroll chamber 12 is formed by the intake-side wall surface 21, the inner circumferential side wall surface 32 and the outer circumferential side wall surface 41 in a circumferential direction outside the impeller 10.

Concurrently with assembling as mentioned above, the protruding part 42 is inserted in the penetration part 22. As illustrated in FIGS. 4 and 5, the penetration part 22 is formed of a cylindrical portion 22*a* extending substantially cylindrically along the axial direction Y. An end of the cylindrical portion 22*a* on the intake side Y1 is open circularly to form the discharge port 13. The center C-side part in the end and its vicinity of the cylindrical portion 22*a* on a Y2 side opposite to the intake side Y1 is cut out. The first intermediate wall surface 23 is formed inside the penetration part 22, as illustrated in FIG. 3. The first intermediate wall surface 23 bends in the formation direction (circumferential direction orthogonal to the axial direction Y) of the scroll chamber 12 from the open direction (axial direction Y) of the discharge port 13 so as to smoothly connect from the discharge port 13 to the intake-side wall surface 21.

The protruding part 42 protrudes to the intake side Y1, as illustrated in FIGS. 4 and 5, and an outer circumferential surface 421 of the protruding part 42 is a surface parallel to the axial direction Y. As illustrated in FIG. 3, the outer circumferential surface 421 is shaped to extend along the inner wall of the cylindrical portion 22*a* forming the penetration part 22. The second intermediate wall surface 43 is formed inside the protruding part 42. The second intermediate wall surface 43 bends in the circumferential direction orthogonal to the axial direction Y from the axial direction Y so as to smoothly connect from the end on the intake side Y1 to the outer circumferential side wall surface 41.

As the result of the protruding part 42 being inserted in the penetration part 22, the first intermediate wall surface 23 and the second intermediate wall surface 43 face each other, thus forming the inner wall surface 14*a* of the intermediate part 14 through which the scroll chamber 12 and the discharge port 13 are communicated with each other. Each of the first intermediate wall surface 23 and the second intermediate wall surface 43 is formed to have a semicircular-arc shape in a cross-section of the surfaces vertical to the flow path of the intermediate part 14. As the result of the both surfaces being disposed facing each other, the inner wall surface 14*a* of the intermediate part 14 is formed to have a substantially circular shape in the cross-section vertical to the flow path direction. Consequently, the intermediate part 14 is formed into a tubular shape.

As illustrated in FIG. 3, the intermediate part 14 is communicated with the discharge port 13 at a leading end 42*a* on the intake side Y1 since the first intermediate wall surface 23 and the second intermediate wall surface 43 are shaped as described above. The intermediate part 14 is also communicated with the scroll chamber 12 formed in the circumferential direction at the basal portion 42*b* (an end on the side Y2 opposite to the intake side Y1) of the intermediate part 14. In addition, the intermediate part 14 bends in the formation direction (circumferential direction orthogonal to the axial direction Y) of the scroll chamber 12 from the open direction (axial direction Y) of the discharge port 13 so as to smoothly connect from the discharge port 13 to the scroll chamber 12.

A pipe (not illustrated) for feeding compressed air discharged from the scroll chamber 12 to an internal-combustion engine is connected to the discharge port 13. Note that a joint made of a deformable material may be interposed between the abovementioned pipe and the discharge port 13.

As illustrated in FIG. 3, an outer circumferential part 24 surrounding the entire area of the scroll piece 20 in the circumferential direction is formed on the outer circumference of the scroll piece 20. An outer circumferential end face 24*a* which is an end face of the outer circumferential part 24 on the side Y2 opposite to the intake side Y1 is a planar surface.

On the other hand, a flange portion 44 protruding in the outer circumferential direction is formed on the outer edge of the seal plate 40. A surface of the flange portion 44 on the intake side Y1 serves as a planate sealing surface 44*a*. Under the condition of the scroll piece 20 and the seal plate 40 being assembled with each other, the outer circumferential end face 24*a* and the sealing surface 44*a* have close contact with each other to be sealed therebetween.

As illustrated in FIG. 2, an intake passage 35 communicated with the intake port 11 is formed inside the shroud press fitting part 31 of the shroud piece 30. In addition, a surface of the shroud piece 30 on the opposite side (intake side Y1) of the diffuser surface 34 serves as an opposite surface 36 opposed to the scroll piece 20 in the axial direction Y. On the other hand, an abutment portion 29 is formed in the scroll piece 20 so as to abut on the opposite surface 36 of the shroud piece 30 in the axial direction Y, as illustrated in FIG. 2. The shroud piece 30 is positioned in place in the axial direction Y by causing the opposite surface 36 to abut on the abutment portion 29 of the scroll piece 20 in the axial direction Y.

Next, working effects of the compressor structure 1 according to the present embodiment will be described in detail.

According to the compressor structure 1 of the present embodiment, the scroll piece 20, the shroud piece 30 and the seal plate 40 are assembled with each other in the axial direction Y. The penetration part 22 penetrating through the scroll piece 20 in the axial direction Y is formed in the scroll piece 20, and an end of the penetration part 22 on the intake-side Y1 constitutes the discharge port 13. The first intermediate wall surface 23 formed extending from the intake-side wall surface 21 forming the scroll chamber 12 in such a manner to bend in the axial direction Y smoothly connects to the discharge port 13. In addition, the protruding part 42 formed protruding in the axial direction Y corresponding to the direction of assembly at the seal plate 40 is inserted in the penetration part 22. The second intermediate wall surface 43 facing the first intermediate wall surface 23 is formed in the protruding part 42. The first intermediate wall surface 23 and the second intermediate wall surface 43 form the inner wall surface 14*a* of the intermediate part 14 through which the discharge port 13 and the scroll chamber 12 are communicated with each other.

With this configuration, the scroll piece 20 forming the discharge port 13 and the seal plate 40 can have a shape releasable from a die (shape having no undercuts) in an insertion direction, i.e., the axial direction Y. It is therefore possible to mold the scroll piece 20 by die casting, instead of gravity casting or low-pressure casting, and reduce the cost of manufacture. The cost of manufacture can also be reduced since a die-casting die for molding the scroll chamber 12 and a die-casting die for molding the discharge port 13 need not be prepared separately. In addition, the compressor structure 1 does not increase the number of components and does not cause any cumbersome and complicated assembling process, compared with conventional compressor structures. The cost of manufacture therefore does not increase.

Each of the first intermediate wall surface and the second intermediate wall surface is formed to have a semicircular-arc shapes in a cross-section of the intermediate part vertical to a flow path. In addition, the first and second intermediate wall surfaces can be formed so as to face with each other so as to allow the inner wall surface of the intermediate part to have a circular shape in the abovementioned cross-section. Consequently, the intermediate part is formed so that a cross-section of the intermediate part in the axial direction is substantially circular and the intermediate part extends in such a manner that an extending direction of the intermediate part approaches a direction parallel to the axial direction.

Yet additionally, in the present embodiment, each of the first intermediate wall surface 23 and the second intermediate wall surface 43 is formed to have a semicircular-arc shapes in a cross-section of the intermediate part vertical to a flow path and to face with each other so as to allow the inner wall surface 14*a* of the intermediate part 14 to have a circular shape in the abovementioned cross-section. Consequently, a cross-section of the discharge port 13 vertical to the flow path direction is substantially circular so as to form the discharge port 13 into a tubular shape extending in the axial direction Y. Accordingly, it is possible to prevent the flow of compressed air from being disturbed in the discharge port 13.

In the present embodiment, both the scroll piece 20 and the seal plate 40 are made by aluminum die casting. Since the materials of both members are the same, the thermal expansion coefficients of the two members equal each other. Accordingly, gaps are less likely to be formed in the sealing parts (outer circumferential end face 23*a* and sealing surface 44*a*) of the two members. It is therefore possible to enhance airtightness of the compressor housing 2.

As described above, according to the present embodiment, it is possible to provide the compressor structure 1 for turbochargers which enable manufacturing cost reduction.

The invention claimed is:

1. A compressor structure for turbochargers configured to be able to accommodate an impeller, comprising:

an intake port for drawing in air toward the impeller;

a scroll chamber formed in a circumferential direction on an outer circumferential side of the impeller in such a manner to flow air discharged from the impeller;

a discharge port for discharging air flowing through the scroll chamber to an outside; and an intermediate part for communicating the discharge port and the scroll chamber, wherein the compressor structure includes a scroll piece, a shroud piece and a seal plate assembled with each other in an axial direction as separate members, wherein the scroll piece includes the intake port formed penetrating in the axial direction; an intake-side wall surface constituting a wall surface of the scroll chamber on an intake side on an outer circumferential side of the intake port; a penetration part formed penetrating in the axial direction and having an intake side end constituting the discharge port; and a first intermediate wall surface configured to constitute a part of the inner wall surface of the intermediate part, smoothly extending from the intake-side wall surface to the discharge port in such a manner that an extending direction of the first intermediate wall surface approaches a direction parallel to the axial direction by being bent toward the intake side, wherein the shroud piece includes a cylindrical shroud press fitting part to be press-fitted into the intake port; an inner circumferential side wall surface constituting a wall surface on an inner circumference side of the scroll chamber; a shroud surface opposed to the impeller; and a diffuser surface extending from the shroud surface toward the scroll chamber, wherein the seal plate includes an outer circumferential side wall surface constituting a wall surface on an outer circumferential side of the scroll chamber; and a protruding part protruding toward the intake side so as to be inserted into the penetration part in the axial direction, wherein the protruding part includes a second intermediate wall surface configured to constitute a part of the inner wall surface of the intermediate part, the second intermediate wall surface extending from the outer circumferential side wall surface in such a manner that an extending direction of the second intermediate wall surface approaches a direction parallel to the axial direction by being bent toward the intake side, wherein the second intermediate wall surface faces in a direction of the first intermediate wall surface, and each of the first intermediate wall surface and the second intermediate wall surface is formed to have a semicircular-arc shape in a cross-section of the intermediate part vertical to a flow path, wherein the semicircular-arc shape of each of the first intermediate wall surface and the second intermediate wall surface form a circular shape in cross-section for the inner wall surface of the intermediate part, and wherein each of the first intermediate wall surface and the second intermediate wall surface bend to a direction approaching parallel to the axial direction from a direction orthogonal to the axial direction.

* * * * *